United States Patent [19]

Ohbu et al.

[11] 3,962,501

[45] June 8, 1976

[54] METHOD FOR COATING OF CORROSION-RESISTANT MOLTEN ALLOY

[75] Inventors: Misao Ohbu; Seijun Higuchi, both of Kitakyushu, Japan

[73] Assignee: Nippon Steel Corporation, Tokyo, Japan

[22] Filed: Apr. 29, 1975

[21] Appl. No.: 572,843

Related U.S. Application Data

[63] Continuation of Ser. No. 424,704, Dec. 14, 1973, abandoned.

[30] Foreign Application Priority Data

Dec. 15, 1972 Japan ..... 47-125987

[52] U.S. Cl. ..... 427/433; 75/178 AN; 427/321; 427/367

[51] Int. Cl.[2] ..... B44D 1/52; C22C 8/00

[58] Field of Search ..... 75/178 AN; 427/433, 427/431, 321, 367

[56] References Cited

UNITED STATES PATENTS

| | | | |
|---|---|---|---|
| 1,755,559 | 4/1930 | Pletsch | 427/310 |
| 2,557,764 | 6/1951 | Renkin | 427/433 X |
| 2,634,469 | 4/1953 | Pershing | 75/178 AN |
| 2,894,850 | 7/1959 | Greene et al. | 427/433 X |
| 3,245,765 | 4/1966 | Lawson | 427/433 X |

*Primary Examiner*—Thomas J. Herbert, Jr.
*Attorney, Agent, or Firm*—Toren, McGeady and Stanger

[57] ABSTRACT

Coating of steel articles with zinc-tin alloys by hot-galvanizing with addition of aluminum to improve the applicability and adhesion of the coating as well as the corrosion resistance, coated surface appearance and formabilities thereof.

5 Claims, No Drawings

METHOD FOR COATING OF CORROSION-RESISTANT MOLTEN ALLOY

This is a continuation of application Ser. No. 424,704 filed Dec. 14, 1973, now abandoned.

DETAILED EXPLANATION OF THE INVENTION

This invention relates to a method of coating steel materials with a Zn—Sn alloy. In particular, the present invention relates to a hot-dip coating for zinc-tin alloy articles having improved corrosion-resistance, workability and coating properties, as well as strong adherence and fine surface appearance.

In a brief summary of the invention, it has an object to provide a method of producing a Zn—Sn—Al alloy coating on steel by hot-dip galvanizing, said alloy composition comprising 3 – 97% by weight of zinc, 97 – 3% by weight of tin, and 0.005 – 25% by weight of aluminum based on the total weight of the zinc and tin. The method provides coatings having a smooth surface of fine appearance as well as greatly enhanced corrosion resistance, workability and such strong adhesion to the steel base that the resulting articles are highly durable during the forming operation.

Over the years, there has been a gradual but continual growth in the use of surface-treated steel materials in applications requiring high corrosion resistance and adhesion of galvanized coatings which are highly durable during forming operations such as drawing and bending as well as the forming of the resulting steel articles themselves.

For many of these applications, Zn-Sn alloy coated steel, Sn—Cd alloy coated steel and Zn—Cd alloy coated steel are widely used, all of which are produced by electroplating. However, these alloy coatings have unstable alloy compositions which deviate from the desired predetermined formulations. In order to reduce the deviations to zero, the electrolytic bath should be severely controlled. Moreover, the electrodeposition rate can not always be said to be large so that in producing industrial coatings of required thicknesses, difficult problems such as increased cost and complicated apparatus are encountered. In addition, after-treatments for the used solution of the electrolytic bath and cadmium contained therein create difficult problems from the point of pollution.

As examples of a coating produced by hot galvanizing and having the above-mentioned performances, mention may be made of lead metal or lead and tin alloy coatings. However, these coatings have defects in that they are susceptible to pin holes which cause serious damage, such as, corrosion to the coated product. Also the use of lead is undesirable from the point of pollution.

Of these alloy coatings having enhanced corrosion resistance and workability, the present invention is directed to the field of Zn—Sn alloy coatings, and it contemplates overcoming the above-mentioned various problems and drawbacks which arise in the manufacture of galvanized steel articles by electroplating, and establishing the coating of steel articles with modified Zn—Sn alloy by hot dipping to provide alloy coated articles having superior performances and appearance at lower manufacture cost, as compared to those afforded by electroplating.

In the practice of the present invention, a molten zinc and tin alloy bath is made containing 0.005 – 25% by weight of aluminum based on the total weight of the alloy, and the steel surface, suitably cleaned, is immersed in the alloy bath to establish on the surface an alloy layer that solidifies after the surface is withdrawn from the alloy bath as a coating adherent thereto having fine surface appearance, high corrosion resistance and strong adhesion to the steel base. The resulting hot-dip alloy coated steel articles have improved workability.

Improvements for which the invention is adapted over the prior art will next be described in detail. In general, a molten Zn—Sn alloy bath containing of 3 – 97% by weight of zinc and 97 – 3% by weight of tin is very susceptible to oxidation at the surface to produce viscous oxides, while in the body there is produced dross in a far larger proportion than in the case of single zinc or tin bath.

Therefore, the hot-dip coated steel articles resulting from such a Zn—Sn alloy bath have large amounts of finely-divided dross adhering to the coatings however, which the surface portions under the dross are not coated. Further, a great number of oxide flakes are allowed to deposite on the alloy layer when the immersed steel material is withdrawn from the alloy bath, so that the resulting hot-dipped steel articles have many defects such as metallic luster-poor appearance, large surface roughness and the like which reduce the commercial values of the coated articles. Aside from these disadvantages, the formation of Fe—Zn alloy layer produced between the alloy coating and the steel base lowers the workability of the articles, although the alloy coating itself is sufficiently flexible in forming operation, thereby resulting in an additional disadvantage.

Also in case of a molten Zn—Al alloy bath containing 75 to 99.5% Zn and 0.5 to 25% Al, the oxidation of the bath surface is severe and a large amount of viscous oxides is formed on the bath surface. Thus, just as in case of the Zn-Sn alloy coating, the metal surface is contaminated with fine dross and the oxides from the bath surface, and such contaminated portions remain often uncoated.

Particularly when the metal materials to be coated are cleaned or activated by a gas reducing method such as Sendzimer method or a non-oxidizing furnace method, the influence of the reducing atmosphere (dew point and oxygen content, etc.) is so large that uncoated portions due to deposition of the oxides from the bath surface and unsatisfactory cleaning of the substrate occur very often. This tendency increases as the aluminum content in the bath increases (more than 1%).

In case of Zn—Al alloy coating containing more than 1% of Al, coating adhesion is poor and the coating peels off during working of the coated material.

The present inventors have made attempts to eliminate these drawbacks and disadvantages, and have found that the addition of aluminum to the Zn—Sn alloy bath with above-mentioned composition is very effective for overcoming the aforesaid problems and drawbacks, and that the concentration of aluminum is an important factor.

It is well known that the addition of aluminum to molten zinc bath produces effects such as (1) protection of bath surface against oxidation and increase in the bath fluidity, (2) improvement in luster of surface of coating, and (3) prohibition of Zn—Fe alloy formation reaction to strengthen the adhesion of the coating to the steel base. As far as is known, however, the addition of aluminum to the Zn-Sn alloy bath so far has not been attempted. On this account, experiments for examining the effect of aluminum addition to the alloy coating have been made and the following advantages are found to derive from the addition of aluminum.

An advantage of addition of aluminum to the Zn—Sn alloy composition is that the deposition of finely-divided dross on the alloy coating is essentially prevented from occurring, resulting in a large reduction of uncoated surface portions. Thus, the Zn—Sn—Al alloy has superior coating properties, and the resulting articles exhibit superior corrosion resistant properties and, a smooth surface coating and fine appearance as compared to conventional Zn—Sn alloy or articles afforded by the Zn—Sn alloy coating. This is because the Zn—Sn alloy is applied on steel at a temperature lower than the melting point of zinc, i.e., below 420°C, and because the Zn—Sn alloy is a eutectic mixture which tends to produce a great amount of finely-divided dross due to the segregation of zinc. Some of the dross particles tend to make the Zn—Sn alloy coating porous.

Another advantage is that which can be seen in the case of hot-dipping steel with Zn—Sn alloy, wherein the Zn—Sn—Al alloy also has a retarding effect on the formation of Fe—Zn alloy layer between the alloy and the substrate steel. This indicates that it is possible to increase the adhesion of the alloy coating so that it is highly durable with respect to forming operation of the coated articles.

An additional advantage is that it is possible to uniformly control the thickness of coating by using any of the conventional coating thickness control techniques, as by direct application of a coating from coater rolls, or by means of air or powder spungles, provided the alloy composition is formulated according to the invention. By way of contrast, the Zn—Sn alloy of conventional composition is difficult to apply with uniformly controlled and decreased thickness using these techniques. Therefore, the alloy composition in accordance with the present invention in which relatively expensive tin metal is used has a merit of greatly reducing the manufacturing cost of coated steel articles having a decreased coating thickness, and the reduction of the coating thickness contributes to the attaining of a good adhesion.

As far as the step of applying the Zn—Sn—Al alloy coating by hot-dip coating is concerned, the procedure may be wholly conventional. Thus, for example, the steel surface, suitably pretreated such as precleaned and activated, may be immersed in a molten alloy bath containing zinc, tin and aluminum, and withdrawn with selection of conditions to produce a desired coating thickness. The hot-dip coating operation is well known in the art and accordingly need not be described in detail.

In the preferred embodiment of the invention, the alloy composition comprises 3 – 97%, preferably 5 – 75% by weight of zinc; 97 – 3%, preferably 25 – 95% by weight of tin; and 0.005 – 25%, preferably 0.005 – 0.3% by weight of aluminum based on the total weight of the zinc and tin. When the material is treated by a flux method, the control of aluminum concentration in the Zn—Sn alloy is particularly important. When the concentration is less than 0.005%, the above-mentioned good results can not be obtained. When the aluminum concentration exceeds 25% the porosity of the coating is increased relative to the increase in the content of tin.

The effects of tin and aluminum addition in the case where the material is treated by a flux method the case where the material is treated under non-oxidizing condition or with reducing gas, are shown in Tables 1 to 4 respectively.

Table 1

Coating Adhesion and Sn Contents in Zn-Sn-0.005% Al Bath

| Bath Composition | Coating Adhesion |
|---|---|
| Zn — 10% Sn — 0.005% Al | Bad |
| Zn — 20% Sn — 0.005% Al | Bad |
| Zn — 25% Sn — 0.005% Al | Good |
| Zn — 40% Sn — 0.005% Al | Very good |
| Zn — 60% Sn — 0.005% Al | " |
| Zn — 80% Sn — 0.005% Al | " |
| Zn — 90% Sn — 0.005% Al | " |
| Zn — 95% Sn — 0.005% Al | " |

Table 2

Effects of Al Contents on Coating Adhesion, Coating Property and Appearance

| Bath Composition | Coating Adhesion | Coating Property* and Appearance |
|---|---|---|
| Zn — 30% Sn | Bad | Bad deposition of oxides |
| Zn — 30% Sn — 0.0025% Al | Good — Bad | Good appearance |
| Zn — 30% Sn — 0.005% Al | Very good | Very good appearance |
| Zn — 30% Sn — 0.010% Al | " | " |
| Zn — 30% Sn — 0.050% Al | " | " |
| Zn — 30% Sn — 0.10% Al | " | " |
| Zn — 30% Sn — 0.30% Al | " | " |
| Zn — 30% Sn — 0.50% Al | " | ** |

*Coating was done by a flux method and Sendzimir method.
**Appearance is very good in case of Sendzimir method but non-coated portions occur in case of a flux method.

Table 3

Effects of Sn Contents on Coating Adhesion, Coating Property and Appearance

| Bath Composition | Coating Adhesion | Coating Property and Appearance |
|---|---|---|
| Zn — 5% Sn — 0.30% Al | Bad | Very good appearance |
| Zn — 10% Sn — 0.30% Al | Good | " |
| Zn — 20% Sn — 0.30% Al | Very good | " |
| Zn — 30% Sn — 0.30% Al | " | " |
| Zn — 40% Sn — 0.30% Al | " | " |
| Zn — 60% Sn — 0.30% Al | " | " |
| Zn — 70% Sn — 0.30% Al | " | Non-coated portion occurs and much cross deposition |

(Coating was done by Sendzimir method and non-oxidizing method.)

Table 4

Effects of Al Contents on Coating Adhesion, Coating Property and Appearance

| Bath Composition | Coating Adhesion | Coating property and Appearance |
|---|---|---|
| Zn — 20% Sn — 0.005% Al | Bad | Very good appearance |
| Zn — 20% Sn — 0.10% Al | Good — Bad | " |
| Zn — 20% Sn — 0.30% Al | Very good | " |
| Zn — 20% Sn — 0.50% Al | " | " |
| Zn — 20% Sn — 1.0% Al | " | " |
| Zn — 20% Sn — 10% Al | " | " |
| Zn — 20% Sn — 20% Al | " | " |
| Zn — 20% Sn — 25% Al | " | Good |
| Zn — 20% Sn — 30% Al | " | Many of non-coated portions and cross deposition |

(Coating was done by Sendzimir method and non-oxidizing method.)

The temperature of the alloy bath may be controlled to that higher than the melting point of the Zn—Sn alloy by 20° – 150°C preferably by 30° – 100°C.

The dipping period is generally from 1 second to 10 minutes, preferably 5 seconds to 5 minutes, depending upon both the coating thickness and the size of steel articles to be coated.

The selection of conditions to produce a desired coating thickness is the same as in the case of the application of zinc coating, tin coating and lead-tin alloy coating, and the thickness control is effected by means of rolls, or air or powder spungle. The alloy coatings have superior characteristics to those of conventional alloy coatings of similar thickness.

It is to be noted that within the scope of the present invention, besides the bath containing zinc, tin and aluminum, the bath further contains incident impurities such as Pb, Fe, Cd, Sb, As, Cu, Si, Mg, Mn and the like which have their sources in the used zinc metal, tin metal and aluminium metal. Further it is clear that some iron unavoidably dissolves into the alloy from steel articles during the hot-dipping as well as from the bath vessel and other coating instruments.

The invention will now be further illustrated in and by the following examples.

EXAMPLE 1

A molten alloy bath was made containing 80% by weight of a distilled zinc metal, 20% by weight of two tin metals, and 0.3% by weight of two aluminum metals. A cold rolled steel sheet according to Sendzimir method, was immersed in the molten alloy bath at 420°C for 5 seconds, and then withdrawn at a coating of 240 g/m² to obtain an alloy-coated steel sheet having a smooth surfaces of fine appearance and having improved formabilities and coating adhesion.

As a control, using an alloy bath of the above bath composition but excluding aluminum, a hot-dip coating operation was carried out in a manner similar to the above. The resulting steel sheet had finely-divided dross and oxide flakes adhering to the surfaces thereof in large coverages. The application of the coating was considerably difficult, and the surface of the coated steel sheet was poor in metallic luster. According to a ball-impact test and a reverse bending test, the adhesion of the coating to the steel base was proven to be far inferior to that afforded in the above Example.

EXAMPLE 2

A molten alloy bath composition was made containing 60% by weight of a distilled zinc metal, 40% by weight of two tin metals and 0.05% by weight of two aluminum metals. A steel pipe was immersed in the molten alloy bath at 400°C for 2 minutes according to a dry flux method using zinc chloride and ammonium chloride, and then withdrawn with a coating of 300 g/m² to obtain an alloy coated steel pipe having a smooth surface of fine appearance. Also the coating adhesion and formabilities were very good.

As a control, using a bath of the above composition but excluding aluminum, a hot-dip coating operation was carried out in a manner similar to the above. The steel pipe thus coated had very bad coating, and surface appearance as in Control I. According to a hummer test and bend test, the coating adhesion was far inferior to that afforded in the above Example.

EXAMPLE 3

A molten alloy bath composition was made containing 40% by weight of a usually available zinc metal, 60% by weight of a tin metal and 0.01% by weight of an aluminum metal. A cold-rolled steel sheet was immersed in a body of the molten alloy at 370°C for 10 seconds according to a dry flux method using zinc chloride and ammonium chloride, and then withdrawn at a coating coverage of 35 g/m². The steel sheet thus coated had a smooth and fine surface appearance, and good coating adhesion and workabilities.

As a control, using an alloy bath with the above composition but excluding aluminum, a hot-dip coating operation was carried out in a manner similar to the above. The resulting steel sheet had a very bad coating and surface appearance. According to a ball-impact test and bend test, the coating adhesion also was far inferior to that afforded in the above Example.

EXAMPLE 4

A molten alloy bath composition was made containing 80% by weight of a usually available zinc metal, 20% by weight of a tin metal and 0.1% by weight of an aluminum metal. A steel wire was immersed in the molten alloy bath at 330°C for 30 seconds according to a wet flux method, and then withdrawn at a coating of 240 g/m² to obtain an alloy coated steel wire having a smooth surface of fine appearance. Also the coating adhesion and formability of the resulting steel wire were very good.

As a control, using an alloy bath with the above composition but excluding aluminum, a hot-dip coating operation was carried out in a manner similar to the above. The resulting steel wire had a very bad coating and surface appearance, and the coating adhesion also was far inferior to that afforded in the above Example.

EXAMPLE 5

A molten alloy bath composition was made containing 70% by weight of a special zinc metal, 30% by weight of tin metal and 0.1% by weight of an aluminum metal. A cold rolled steel was immersed in a body of the molten alloy at 410°C for 5 seconds according to Sendzimir method, and then withdrawn at a coating of 45 g/m² to obtain an alloy-coated steel sheet having smooth surfaces of fine appearance. Also the coating adhesion and formabilities were very good.

As a control, using an alloy bath having the above composition but excluding aluminum, a hot-dip coating operation was carried out in a manner similar to the above. The resulting steel sheet had a very bad coating and surface appearance as in Control I. According to a ball-impact test and reverse bend test, the coating adhesion was far inferior to that afforded in the above Example.

EXAMPLE 6

A molten bath containing the following components was prepared.

| | |
|---|---|
| Distilled zinc metal (No. 1 grade) | 85% |
| Tin metal | 10% |
| Aluminum metal (No. 2 grade) | 5% |

A cold rolled steel sheet was immersed in the above molten bath at 420°C for 5 seconds according to Sendzimir method and withdrawn with a coating of 120 g/m² to obtain an alloy coated steel sheet having a smooth surface of fine appearance. The corrosion resistance and coating adhesion and workability of the alloy coated steel sheet were excellent.

As a control, a cold rolled steel sheet was immersed in a bath of Zn (containing 10 – 20% Sn), and in a bath of Zn (containing 5 – 10% Al) at a temperature 30 to 50°C higher than the melting point of the respective bath under the same coating conditions as above. In this control, the surface of the steel sheet was contaminated with fine dross and oxides floating on the bath surface, and was very difficult to coat. The coating adhesion (tested by a ball impact test and a reverse bend test), workability (drawing and bending) and corrosion resistance (tested by a salt spray test of JIS-Z-2371 and a humidity cell test of JIS-Z-0228) of the thus coated steel sheet was remarkably inferior to those obtained by the above Example.

EXAMPLE 7

A coating bath containing the following components was prepared.

| | |
|---|---|
| Distilled zinc metal (No. 1 grade) | 70% |
| Tin metal (No. 2 grade) | 20% |
| Aluminum metal (No. 2 grade) | 10% |

A cold rolled steel sheet was immersed in the above bath at 420°C for 3 seconds according to a non-oxidizing furnace method to obtain a coating of 75 g/m² on the steel sheet. The coated surface was smooth and fine, and the coating adhesion, workability and corrosion resistance of the thus coated steel sheet were excellent. Also the coated steel sheet showed very fine appearance after lacquering.

As a control, the coating was done in a bath of Zn containing 20 to 30% Sn and a bath of Zn containing 10 – 20% Al at a temperature of 30° to 50°C higher than the melting point of the respective bath under the same coating conditions. The appearance of the thus coated steel sheet was very poor, and the coating adhesion, workability and corrosion resistance were remarkably inferior.

EXAMPLE 8

A coating bath containing the following components was prepared.

| | |
|---|---|
| Special zinc metal | 58% |
| Tin metal (No. 1 grade) | 40% |

-continued

| | |
|---|---|
| Aluminum metal (No. 1 grade) | 2% |

A cold rolled steel sheet was immersed in the above bath at 400°C for 1 second according to Sendzimir method to obtain a coating of 50 g/m² on the steel sheet. The appearance of the coated surface was smooth and fine, and the coating adhesion, workability and corrosion resistance of the thus alloy coated steel sheet were excellent.

As a control, the coating was done in a bath of Zn containing 45 to 55% Sn, and a bath of Zn containing 1 – 3% Al at a temperature of 30° to 50°C higher than the melting point of the respective bath under the same coating conditions. The coating was very difficult to achieve, the coating appearance was very poor, and the coating adhesion, workability and corrosion resistance of the coated steel sheet by the control were remarkably inferior.

These examples show that the inclusion of aluminum in zinc-tin alloy improves remarkably the coating properties and the surface appearance of the steel articles coated with the Zn—Sn—Al alloy as well as the coating adhesion and formabilities thereof.

While specific examples of the invention have been described, it will be evident that other variations of the invention are possible within the scope of the following claims.

What is claimed is:

1. A method of coating a steel substrate with a corrosion resistant alloy, comprising immersing said steel substrate in an alloy bath, said bath being at a temperature in the range from 20° to 150°C above the melting point of said alloy and containing 75 to 5% by weight zinc, 25 to 95% by weight tin and 0.005 to 25% by weight of aluminum, based on the total bath composition.

2. A method according to claim 1, in which the molten bath contains 0.005 – 0.3% by weight of aluminum, and the material is pretreated with flux.

3. A method according to claim 1, in which the molten bath contains 40 – 60% by weight of tin and 0.30 – 25.0% by weight of aluminum and the material is cleaned and activated by reducing gas.

4. The method of claim 1, wherein said alloy bath is at a temperature in the range from 30° to 100°C above the melting point of said alloy.

5. A method of coating a steel substrate with a corrosion resistant alloy, consisting essentially of immersing said steel substrate in an alloy bath, said bath being at a temperature in the range from 20° to 150° above the melting point of said alloy, and containing 90 to 5% by weight zinc, 10% to 95% by weight tin and 0.3 to 25% by weight of aluminum, based on the total bath composition.

* * * * *